United States Patent [19]

Dickinson

[11] Patent Number: 5,042,141

[45] Date of Patent: Aug. 27, 1991

[54] DEVICE FOR PLACING A VALVE ON A CAN

[75] Inventor: Frederick A. Dickinson, Hertford, England

[73] Assignee: Glaxo Group Limited, London, England

[21] Appl. No.: 483,269

[22] Filed: Feb. 16, 1990

Related U.S. Application Data

[63] Continuation of Ser. No. 203,669, Jun. 7, 1988, abandoned.

[30] Foreign Application Priority Data

Jun. 8, 1987 [GB] United Kingdom ..... 8713342

[51] Int. Cl.[5] ..... B23P 19/04

[52] U.S. Cl. ..... 29/776; 29/801

[58] Field of Search ..... 29/773, 776, 801, 823, 29/705, 778; 222/56, 82, 153, 402.22, 402.23, 402.24

[56] References Cited

U.S. PATENT DOCUMENTS

| | | | |
|---|---|---|---|
| 2,986,809 | 6/1961 | Focht | 29/776 |
| 3,248,785 | 5/1966 | Aidlin | 29/776 X |
| 3,518,744 | 7/1970 | Boyd | 29/776 |
| 3,616,513 | 11/1971 | Dimond | 29/776 |
| 3,708,854 | 1/1973 | Nalbach | 29/776 X |
| 3,739,449 | 6/1973 | Bergerron | 29/776 X |
| 3,880,207 | 4/1975 | Giuttredi | 29/776 X |

FOREIGN PATENT DOCUMENTS

| | | |
|---|---|---|
| 673475 | 6/1952 | United Kingdom . |
| 1018927 | 2/1966 | United Kingdom . |
| 1223093 | 2/1971 | United Kingdom . |
| 1251865 | 11/1971 | United Kingdom . |
| 1393481 | 5/1975 | United Kingdom . |
| 1413897 | 11/1975 | United Kingdom . |
| 1473295 | 5/1977 | United Kingdom . |

*Primary Examiner*—Mark Rosenbaum
*Assistant Examiner*—Peter Dungba Vo
*Attorney, Agent, or Firm*—Darby & Darby

[57] ABSTRACT

A device is provided for placing a valve on an aerosol can. The device comprises a rotatable wheel (1, 101) which has arcuate cut-outs (2, 102) which receive and carry the cans. An arcuate track (**6, 106*b*) follows part of the periphery of the wheel and converges towards it, and along this track valves are pushed by dogs (7, 104), provided adjacent each cut-out (2, 102**). Each valve thus travels in alignment with its respective can and approaches it until it is placed thereon.

12 Claims, 5 Drawing Sheets

DEVICE FOR PLACING A VALVE ON A CAN

This is a continuation, of application Ser. No. 203,669, filed June 7, 1988, now abandoned.

BACKGROUND OF THE INVENTION

This invention relates to a device for placing a valve on a can.

An aerosol dispenser, i.e. a container from which material in aerosol form is to be dispensed, typically comprises a can within which the material is contained and a dispensing valve which is mounted in the open upper end of the can. A typical process for producing an aerosol-containing dispenser will now be described, referring to an example where the material to be dispensed is a drug. It will be understood, however, that this is only an example and that the invention is equally applicable to any other product dispensed in aerosol form, and also to product dispensed in non-aerosol form.

In this typical process a drug and a propellant which is liquid at room temperature are introduced into a can mixed to form a slurry. This takes place at a filling station. The slurry-containing can then passes to a crimping station and as it does so a valve is placed on the open upper end of the can. At the crimping station the valve is crimped onto the can to provide an air-tight seal between the can and valve. The can and valve assembly then passes to a gasing station where a propellant which is different from the first mentioned propellant and which is a gas at room temperature is forced under pressure into the can through the valve.

The period of time when the can is between the filling station and the crimping station is normally short, particularly if the process is operating at high speed, and this creates problems as regards the placing of the valves on the cans.

FIG. 1 of the accompanying drawings shows schematically one way in which valve placement is carried out. The cans A travel from left to right as seen in the drawing, and valves B are fed by guide means (not shown) to the position indicated in FIG. 1. In this position the valve is inclined with respect to the horizontal and when it is struck by the leading upper edge of the can it tips as indicated by the curved arrow and falls onto the open upper end of the can with the valve stem C pointing vertically upward. There are, however, considerable problems with this approach. The precise position of the valve at the instant it is struck by the can is critical. The valve cannot be too high up or the can will not strike it at all, and it cannot be too low down as there is only a very small clearance, indicated by d in FIG. 1, between the upper edge of the can and the portion of the valve which, when the valve is placed on the can, is lowermost. If the can were to strike that portion the valve would not fall correctly on the can.

Other methods of placing valves onto cans have been tried, but none has been particularly successful, and it is an object of the present invention to provide an improved method of placing a valve on a can.

SUMMARY OF THE INVENTION

According to the present invention there is provided a device for placing a valve on the open upper end of a can, comprising means for conveying the can along a first path, and means for conveying the valve along a second path which is at an angle with respect to the first path and converges towards it, the two conveying means operating substantially in unison to cause a valve carried by the first conveying means to approach the can and be placed thereon.

Preferably the first conveying means is a rotatable member, for example a star wheel, and the second conveying means is an arcuate chute. Preferably the first path is substantially horizontal and the second path is downwardly inclined.

BRIEF DESCRIPTION OF THE DRAWINGS

FIG. 1 is a schematic view illustrating the placement of a valve on a can in accordance with the prior art.

DETAILED DESCRIPTION OF THE DRAWINGS

Figure 1:
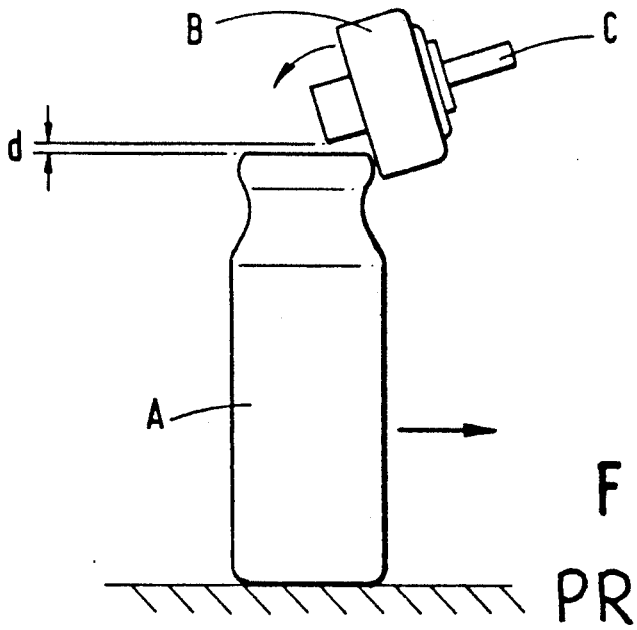
Fig. 1 PRIOR ART
FIG. 1 is illustrative of the prior art and the invention is illustrated in FIGS. 2 to 7 of the accompanying drawings.
Figure 2:
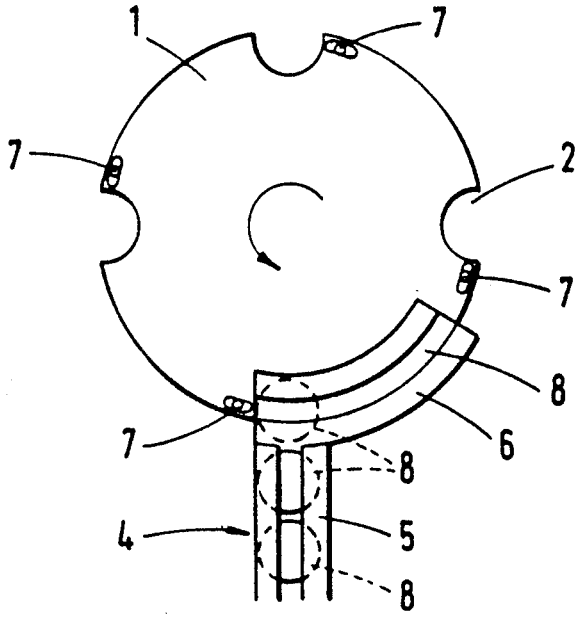
FIG. 2 is a diagrammatic plan view of an embodiment of a device according to the invention.
Figure 3:
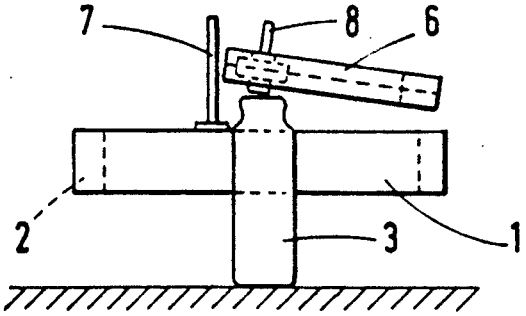
FIG. 3 is a diagrammatic elevation of the device of FIG. 2.

The device shown in FIGS. 2 and 3 comprises a star wheel 1 having four recesses 2 spaced at 90° from one another about the periphery of the wheel 1. Each recess 2 is of a size and shape to engage a can 3 and transport it along an arcuate path.

Valves to be placed on cans 3 are fed down an inclined chute 4 having a first portion 5 extending radially towards the star wheel 1 and a second portion 6 which is arcuate and has the same radius of curvature as the outside of the star wheel. In use, cans are received by the recesses 2 in the star wheel 1 from the filling station. A continuous train of valves 8 is fed down the portion 5 of the chute 4, to where the chute portion 5 meets the arcuate chute portion 6. The chute portion 5 is preferably inclined downwardly, so that the valves travel along it under the influence of gravity. Alternatively, however, the chute portion 5 could be horizontal, with the valves propelled along it by some other means, for example by linear vibration, a current of air or a belt drive.

The valve is then carried along the chute portion 6 by a driving dog 7 of which there are four mounted on the star wheel 1 although only one is shown in FIG. 3. The dog enters and passes along slots 208 provided in the top and bottom of the chute portion 6, and as it does so it drives a valve 8 before it. The dogs 7 are so positioned in relation to the recesses 2 that each valve is carried along immediately above the open end of a can 3 and in unison therewith. The chute portion 6 is downwardly inclined, as can be seen in FIG. 3, with the result that as the valve is carried along the chute portion 6 it approaches the open end of the can and is placed thereon. It is to be understood that this placement does not necessarily involve the valve being in contact with the can by the time the valve reaches the downstream end of the chute portion 6, but if there is no such contact then at least the valve must be close enough to the can for it to fall reliably into position on the can after leaving the chute.

Figure 4:
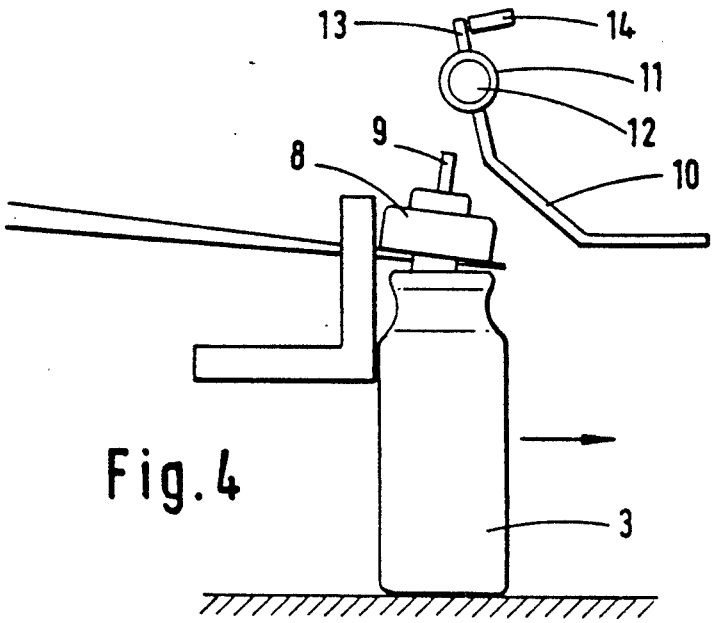
FIG. 4 shows in elevation, an additional feature which may be incorporated in the embodiment of FIGS. 2 and 3.

In order to improve the reliability with which the valve is located on the can, means may be provided to press the valve on to the can after it has been positioned thereon by the device described above. An example of such a pressing means is shown in FIG. 4. This comprises a pair of wires 10 which are connected to a shaft 11 which is freely pivotal about an axis 12. FIG. 4 can show only one wire, and it is to be understood that there is a second wire behind the wire shown and running parallel thereto. A stop portion 13 extends from the shaft 11 and, in the rest position, is in contact with a stop member 14 which causes the device to adopt the position shown in the drawing. As the can and valve move together in the direction shown by the arrow an upwardly facing surface of the valve comes into contact with the wires 10, the wires passing on opposite sides of the valve stem 9. The wires thus press the valve lightly down on to the can as they and shaft 11 pivot about the axis 12 in an anti-clockwise direction.

Figure 5A:
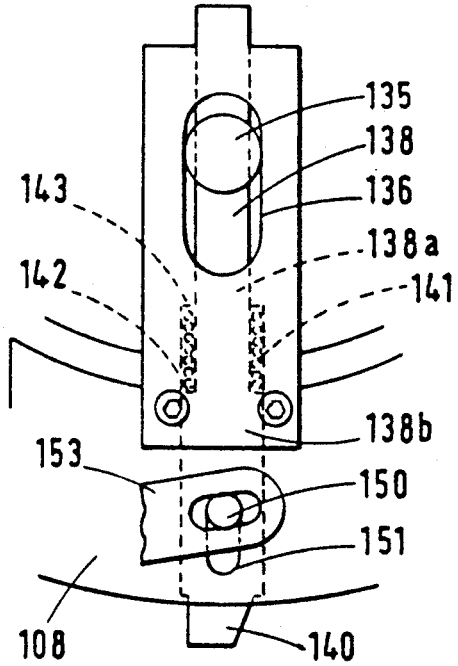
FIGS. 5*a* and 5*b* show details of FIG. 5 on a larger scale.
Figure 5B:
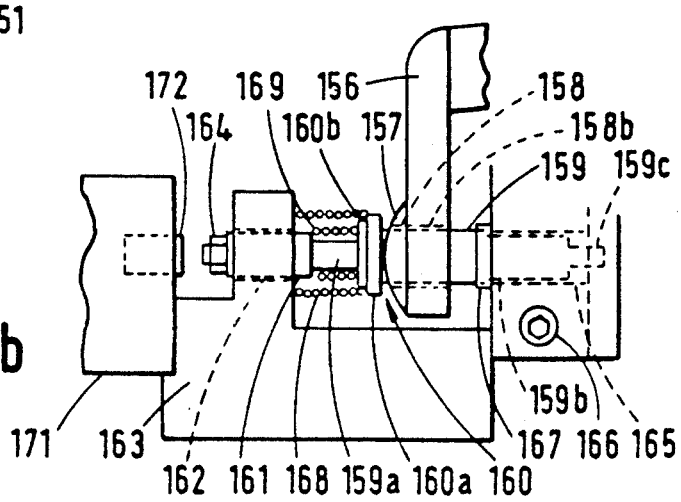
Figure 5:
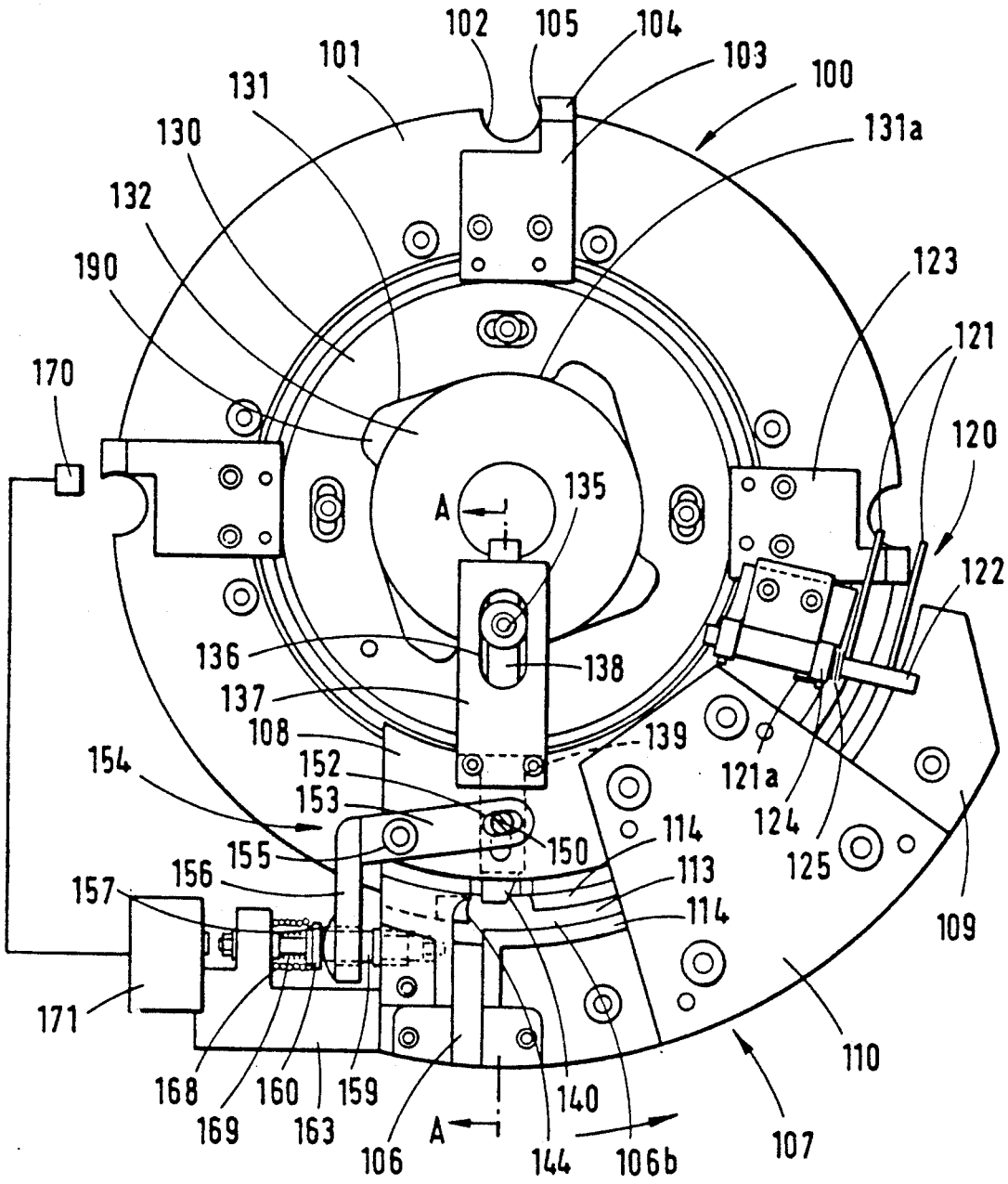
FIG. 5 is a plan view showing in more detail part of an embodiment of the invention.
Figure 6:
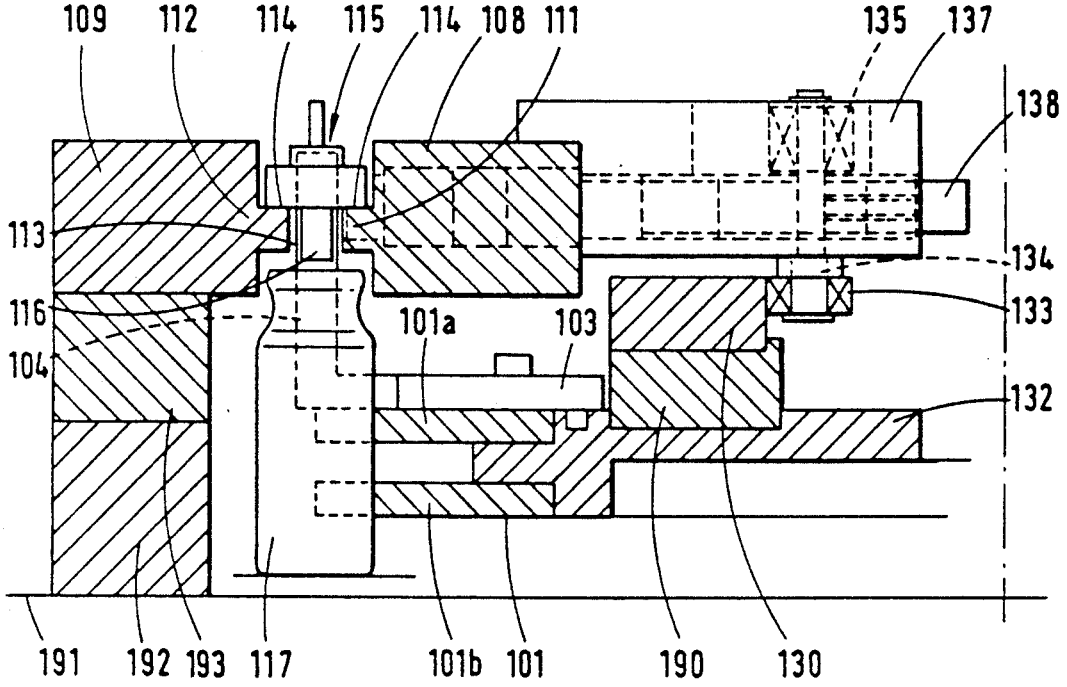
FIG. 6 relates to the embodiment of FIG. 5 and is a vertical section on line A—A in FIG. 5 showing a detail of a valve being placed on a can.

FIGS. 5 to 7 show an embodiment of the invention in more detail, and this embodiment will now be described. The valve placement device 100 comprises a star wheel 101 with four recesses 102 corresponding to the recesses 2 in the embodiment of FIGS. 2 and 3. In use, the wheel 101 rotates in the direction indicated by an arrow in FIG. 5, i.e. in an anti-clockwise direction as viewed in that Figure. A respective plate 103 is secured to the wheel 101 adjacent each recess 102, and the radially outer portion of the plate carries an upstanding pin or dog 104 which corresponds in function to the dog 7 in the embodiment of FIGS. 2 and 3. The forward surface 105 of each dog is convexly curved as viewed in plan, so as to continue the curvature of the recess 102 and thus securely engage the valve which it is to push.

The valves which are to be placed on the cans are introduced through a chute (not shown) into a guide channel 106 defined in a stationary guide assembly 107. The guide assembly 107 comprises an inner section 108 and an outer section 109 connected by an upper connecting block 110 and a lower connecting block which is located immediately below the upper connecting block and is therefore not visible in FIG. 5. The guide channel 106 comprises a first portion **106*a* which is directed approximately radially inward, and a second portion 106*b* which extends arcuately. As can be seen in FIG. 6, the inner and outer valve guide sections 108 and 109 are provided with opposed projections 111 and 112 respectively which define a channel 113 between them and coplanar guide surfaces 114 on which the valves can rest. FIG. 6 shows a valve 115 and, as can be seen, its lower portion 116, which is to extend into a can 117, is located in the channel 113. The guide channel second portion 106*b* slopes downwardly as it proceeds anti-clockwise, so that a valve 115 pushed along the guide channel portion 106*b* gradually descends until it is positioned on a can 117, with the valve portion 116** located within the can.

In order to improve the reliability with which the valve is located on the can a pressing device 120 is provided at the downstream end of the guide channel portion **106*b*. The pressing device 120 corresponds in substance to the device shown diagrammatically for the first embodiment in FIG. 4. Thus, the device comprises a pair of wires 121 which are secured at their proximal ends to a pin 122 which is mounted for pivotal movement about its own axis by a retaining plate 123 secured to the inner section 108 of the valve guide assembly. The pin 122 carries a pair of adjustable locking rings 124 on either side of the retaining plate 123, and these can be adjusted longitudinally with respect to the length of the pin so that the radial position of the pin, and hence of the wires 121, can be adjusted. The wires 121, and hence the pin 122, are biassed in a direction to urge the distal ends of the wires downwardly by means of a torsion spring 125. As can be seen, one end of the torsion spring bears on the radially inner one of the wires 121, and the other end 121*a* of the torsion spring bears on the inner section 108 of the guide assembly. The wires 121 thus press each valve lightly and resiliently down onto its respective can and ensure that each valve is correctly positioned with respect to its can by the time it leaves the guide channel second portion 106*b***.

The embodiment shown in FIG. 5 comprises means for ensuring that a valve is free to travel along the arcuate guide channel second portion **106*b* only as and when a can on which the valve can be positioned is located beneath that channel portion. To this end, there is provided a cam ring 130 on which is formed an inner cam surface 131. The cam ring 130 is secured to, and rotates with, the star wheel 101. The cam ring 130 is located around an inner section 132 of the star wheel. The star wheel is driven by a drive motor (not shown) which turns the inner section 132**.

A cam follower 133 bears on the cam surface 131. This can be seen most clearly in FIG. 6. The cam follower 133 is rotatably mounted on the lower end of a shaft 134, the upper end of which carries a roller 135. The roller 135 is guided for radial movement in a channel 136 formed in a housing 137 secured at its radially outer end to the inner section 108 of the valve guide assembly.

The shaft 134 is mounted in a pin 138 which extends through a bore in the block 137 and through an aligned bore 139 in the inner section 108 of the valve guide assembly. The radially outer end of the pin 138 forms a projection 140. As is explained in more detail below, the pin 138 moves radially in and out, and in its radially outer position the projection 140 extends into the arcuate guide channel portion **106*b* to provide a support for a valve which has travelled along the guide channel portion 106*a* and is entering the guide channel portion 106*b***.

As shown in FIG. **5*a*, the pin 138 is urged in a radially outward direction by a compression spring 141 mounted in the block 137. The pin 138 has a smaller diameter portion 138*a* and a larger diameter portion 138*b* which merge with one another via a shoulder 142. The passageway in which the pin is received has a shoulder 143 and the spring 141 is held in compression between the two shoulders. As the star wheel 101 rotates, and with it the cam ring 130, the pin is pulled radially inwardly once every 90° when the cam follower 133 encounters a portion of the cam surface 131, such as that denoted by reference numeral 131*a*, which is radially inward. The cam surface 131 is such that the projection 140 is in its radially outward position at the instant when a valve passes into the channel portion 106*b* from the channel portion 106*a*. The larger diameter portion of the valve rests on the projection 140 and is supported thereby. Further support is provided by the fact that the upwardly projecting valve stem rests against a support surface 144**, and the valve is thus held in the correct orientation with the valve stem pointing vertically upwards.

Once in the channel portion 106*b* the valve starts to move rightwardly under the force exerted by the valves behind it. As soon as the valve reaches the guide surfaces 114 and is supported thereby, the projection 140 is withdrawn by the operation of one of the cam surface portions 131*a* and the cam follower 133, and at this point a respective one of the dogs passes the point where the projection 140 had been and starts to drive valve in sychronism with a can located in the adjacent recess 102.

The pin 138 carries an upwardly extending pivot pin 150 which extends through an opening 151 in the inner section 108 of the valve guide assembly and is received in a slot 152 formed in one arm 153 of a two-armed lever 154. The lever 154 is mounted by a pivot 155 for pivotal movement with respect to the inner section 108 of the valve guide assembly.

The other arm 156 of the lever 154 carries a part-spherical boss 157, and the boss and adjacent part of the arm 156 have aligned apertures 158*a* and 158*b* therethrough (see FIG. 5*b*). A pin 159 passes through the apertures 158*a* and 158*b* and carries a stepped washer 160 which is slidable thereon and has a larger diameter portion 160*a* and a smaller diameter portion 160*b*. The leftward portion 159*a* of the pin 159, as viewed in FIG. 5*b*, i.e. the portion beyond the washer 160, is of reduced diameter and has a sleeve 161 fixed thereto which is slidable in an aperture 162 formed in a stationary mounting 163. The lefthand end of the sleeve can be seen in FIG. 5*b* just protruding from the aperture 162, with the lefthand end of the pin 159 protruding from the sleeve and carrying a retaining nut 164.

At its righthand end the pin 159 has a portion 159*b* of slightly reduced diameter and an end portion 159*c* of still further reduced diameter. These portions are slidably received in an aperture 165 formed in a stationary mounting 166 and a sleeve 167 received thereon. The end portion 159*c* protrudes, in the position shown, into the guide channel portion 106*a*. The pin is biassed into the position shown by two concentric compression springs 168 and 169, with the inner spring 169 being stronger than the outer spring. The spring 168 is held between the washer portion 160*a* and the stationary mounting 163. The spring 169 is held between the washer portion 160*b* and the sleeve 161.

When the device is in the position shown in FIG. 5*b* no valve can pass the pin end portion 159*c*. However, when the pin 138 moves outwardly under the influence of the cam surface 131 and cam follower 133 the lever 154 is caused to pivot about the pivot 155 in a clockwise sense. The boss 157 pushes against the washer 160 urging it leftward against the force of the springs 168 and 169, thereby compressing the spring 168. As the spring 169 is stronger than spring 168 movement of the washer also causes the sleeve 161 to move leftward, carrying with it the pin 159. A valve can then move past the pin end portion 159*c* and come to rest against the projection 140, which is now in its outward position, ready for the next can.

When the pin 138 moves radially inward again the lever 154 returns to its original position, and the pin 159 does also under the influence of the spring 168.

As shown in FIG. 5, a sensor 170, which may be of any convenient type is mounted at about 90° from the projection 140 to detect the presence or absence of a can in a recess 102 as it passes the sensor. The sensor 170 is connected to a piston and cylinder unit 171, shown diagrammatically, which has a reciprocating piston 172. If the sensor 170 detects the absence of a can the piston 172 is caused to move rightwardly into contact with the lefthand end of the pin 159. The pin cannot then move leftward under the influence of the lever 154, and thus valves cannot pass the pin end portion 159*c*. However, pivoting of the lever 154 remains unaffected, leftward movement of the washer 160 causing compression not only of spring 168 but also of spring 169.

If a simpler system is desired the lever 154 can be omitted and the arrangement including pin 159 replaced by a simple pin which is normally biassed to leave the guide channel portion 106*a* free but which can be forced into a channel-blocking position by a piston similar to the piston 172 in the event that no can is detected by the sensor 170.

Figure 7A:
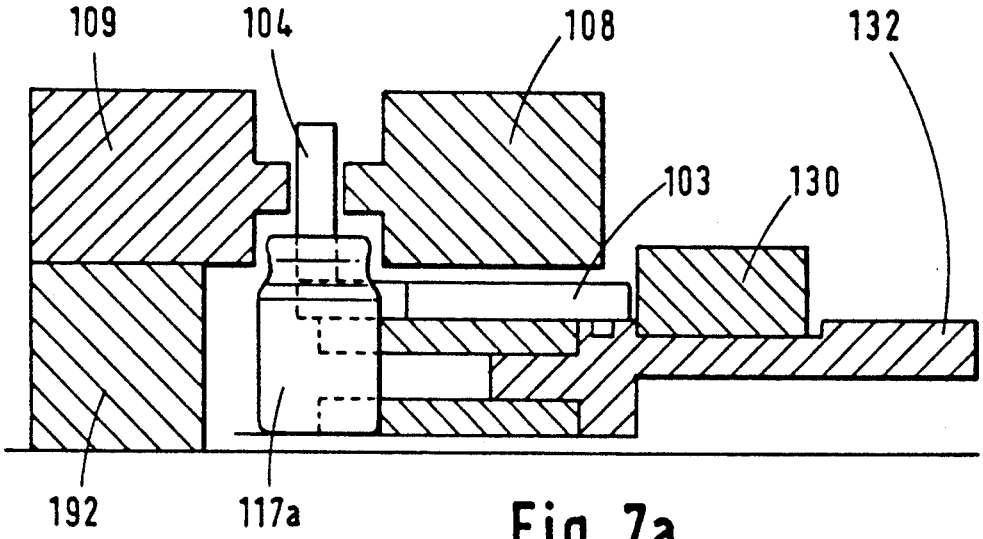
FIGS. 7*a* and 7*b* are similar vertical sections, with parts omitted, showing how the embodiment of FIG. 5 may be adjusted to accommodate small cans and large cans respectively.
Figure 7B:
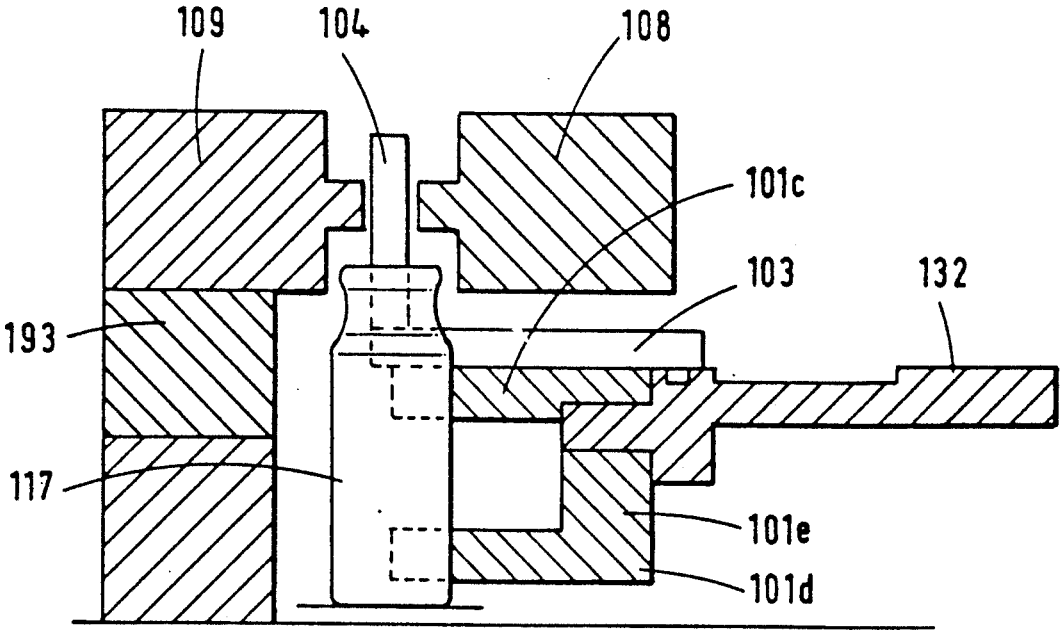

A comparison of FIGS. 6, 7*a* and 7*b* shows how the device may be modified to handle cans of different heights. In the arrangement shown in FIG. 6, which is also that shown in FIG. 5, relatively tall cans are handled. It will be seen in FIG. 6 that for this purpose a spacer ring 190 is inserted between the cam ring 130 and the ring 132. It can also be seen in FIG. 6 that the outer section 109 of the valve guide assembly is mounted on the upper surface of the stationary base of the device, a surface denoted in FIG. 6 by reference numeral 191, via a lower block 192 and an intermediate block 193. Finally with regard to FIG. 6, it will be noted that the periphery of the star wheel 101 has a double construction and consists of upper and lower sections 101*a* and 101*b* respectively separated from one another by a radially outer portion of the ring 132. The portions 101*a* and 101*b* are each provided with a respective recess 102, and the can 117 is thus held at two positions, one above the other, and is therefore held with a greater degree of security than would be the case if it were held at only one such position.

FIG. 7*a* shows the arrangement of FIG. 6 modified to accommodate a shorter can 117*a*. The modification involves the removal of the spacer 190 and the intermediate block 193.

FIG. 7*b* shows a further modification arranged for use with the same tall cans as FIG. 6. In this case the spacer 190 is omitted and the star wheel portions 101*a* and 101*b* are replaced by star wheel portions 101*c* and 101*d*, with the latter having an upwardly extending annular rim 101*e* to support the ring 132 at the required height. This design has the advantage over the design of FIG. 6 in that the two locations at which the can is held are spaced further apart, and the can is therefore held more securely.

What I claim is:

1. A device for placing a valve on the open upper end of a can, said device being of the type including first conveying means for conveying the can along a first path and second conveying means for conveying the valve along a second path which converges toward said first path, the first and second conveying means operating substantially in unison to cause the valve carried by the second conveying means to approach the can and be placed thereon, the improvement comprising said first conveying means comprising a rotatable wheel, and said second conveying means comprising an arcuate track located above said rotatable wheel extending along and following the periphery of said rotatable wheel over a distance, said arcuate track converging downwardly towards said rotatable wheel.

2. The device as claimed in claim 1, comprising means for detecting the presence or absence of a can in the first path as it converges towards the second path, and means responsive to the detection of the absence of a can for inhibiting movement of valves into the second path.

3. The device as claimed in claim 1, comprising intermittently operating valve support means for providing support to a valve as it passes into the second path, to ensure correct orientation of the valve.

4. The device as claimed in claim 1, wherein said rotatable wheel has at least one can holder at or adjacent the periphery thereof for receiving and conveying a can.

5. The device as claimed in claim 4, wherein a pusher member is provided on the wheel adjacent each of said can holders arranged to engage said valve in the arcuate track and propel said valve along the track in unison with a can conveyed in said can holder.

6. The device as claimed in claim 1, wherein said rotatable wheel rotating about a substantially vertical axis and the arcuate track is downwardly inclined.

7. The device as claimed in claim 6, wherein said first conveying means further comprises a recess in the periphery of the wheel.

8. The device as claimed in claim 1 comprising means for exerting a force on each valve after it has been placed on a respective can to urge the valve into a desired position with respect to the can.

9. The device as claimed in claim 8, wherein said force-exerting means comprises a pivotal pin carrying a pair of arms adapted to engage the valve, means being provided for biassing the pin in a sense such that the arms are urged against the valve.

10. The device as claimed in claim 1, comprising a retaining member for preventing a valve from travelling along said second path until a can is located in a position aligned with the valve.

11. The device as claimed in claim 10, wherein the retaining member is arranged to operate in synchronism with the rotation of the wheel.

12. The device as claimed in claim 11, wherein retaining member is arranged to reciprocate into and out of said second path, and the wheel is provided with a cam which rotates therewith and causes said reciprocation.

* * * * *